US006592809B1

(12) United States Patent
Anderson et al.

(10) Patent No.: US 6,592,809 B1
(45) **Date of Patent: *Jul. 15, 2003**

(54) METHOD FOR FORMING POWDER METAL GEARS

(75) Inventors: Gary L. Anderson, St. Marys, PA (US); Jerome E. Muroski, Johnsonburg, PA (US)

(73) Assignee: Keystone Investment Corporation, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/678,703

(22) Filed: Oct. 3, 2000

(51) Int. Cl.[7] ..... B22F 3/24
(52) U.S. Cl. ..... 419/28; 419/38
(58) Field of Search ..... 419/38, 28

(56) References Cited

U.S. PATENT DOCUMENTS

| | | | | |
|---|---|---|---|---|
| 3,752,003 | A | | 8/1973 | Dunn et al. |
| 3,772,935 | A | | 11/1973 | Dunn et al. |
| 3,842,646 | A | | 10/1974 | Kuhn |
| 3,867,751 | A | | 2/1975 | Connell et al. |
| 3,891,367 | A | | 6/1975 | Signora |
| 4,054,449 | A | | 10/1977 | Dunn et al. |
| 4,145,798 | A | | 3/1979 | Sarnes |
| 4,165,243 | A | | 8/1979 | Sarnes et al. |
| 4,470,953 | A | | 9/1984 | Bruce |
| 4,585,619 | A | | 4/1986 | Westin |
| 4,710,345 | A | | 12/1987 | Doi et al. |
| 4,712,411 | A | | 12/1987 | Goodwin |
| 4,770,572 | A | | 9/1988 | Ohkawa et al. |
| 4,871,505 | A | | 10/1989 | Lapeyre |
| 4,920,009 | A | | 4/1990 | Lee et al. |
| 4,924,690 | A | | 5/1990 | Kanamaru et al. |
| 5,366,363 | A | * | 11/1994 | Good et al. ..... 425/78 |
| 5,390,414 | A | * | 2/1995 | Lisowsky ..... 29/893.34 |
| 5,659,955 | A | | 8/1997 | Plamper |
| 5,996,229 | A | | 12/1999 | Yang |
| 6,004,120 | A | | 12/1999 | Matsubara et al. |
| 6,012,350 | A | | 1/2000 | Mizuta et al. |
| 6,013,225 | A | | 1/2000 | Cadle et al. |
| 6,041,640 | A | | 3/2000 | McInerney et al. |
| 6,044,555 | A | * | 4/2000 | Jacob et al. ..... 29/893.34 |
| 6,251,339 | B1 | * | 6/2001 | Beane et al. ..... 419/35 |

FOREIGN PATENT DOCUMENTS

| | | |
|---|---|---|
| FR | 2 607 040 A1 | 11/1986 |

* cited by examiner

*Primary Examiner*—Daniel J. Jenkins
(74) *Attorney, Agent, or Firm*—Kirkpatrick & Lockhart LLP

(57) ABSTRACT

A method for producing a fully dense powder metal helical gear including placing powder metal in a preform die wherein it can be compacted axially by punches to create a gear preform having various gear profiles such as a helical profile, sintering the preform, and inserting the sintered preform into a hot forming die wherein it is impacted axially by punches to fully densify the gear preform. The densified gear can be inserted in a burnishing die where a more precise gear profile can be imparted resulting in more precise dimensions. Finishing treatments, such as rolling, shaving, heat treating, machining to length and inner diameter sizing can be subsequently performed.

10 Claims, 8 Drawing Sheets

METHOD FOR FORMING POWDER METAL GEARS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to a method for producing powder metal gears, and more particularly, to a method for producing fully dense powder metal helical gears.

2. Description of the Background

The production of powder metal articles, including gears, is well-known in the art. One type of alloyed or unalloyed powder metal is selected or different types can be blended together as is known in the art, and additives also may be included with the powder or powder blend. The powder is disposed in a mold cavity which may be a simple cylindrical preform or may have the profile of the finished product. Next, pressure is applied to create the preform. The preform can then be removed and sintered to produce the part.

Apparatus for forming helical gears are also known in the art, wherein portions of the mold rotate when the preform is impacted to cause the preform to take the shape of the helical gear. In this apparatus, the preform has the shape of the actual helical gear to be produced, in contrast to first forming a cylindrical preform that is later transformed into a helical gear.

Another conventional apparatus for making a fully dense powder metal helical gear generally produces the helical gear by first molding a cylindrical preform and then by sintering the preform. The preform is then heated and placed in the forming mold where it is axially impacted to both impact the helical toothed shape and also to densify the gear. A disadvantage of this type of method can be that when the preform is impacted significant flashing can result as the preform is forced into the shape of the helical gear. Consequently, additional finishing processes can be required to deflash the gear before it is acceptable to a customer.

The above-described apparatus utilize mechanically created pressure to form the gear. However, it is also known to utilize isostatic pressure to form a helical powder metal gear. For example, one such method of manufacturing a helical gear from powder metal uses hot and cold isostatic pressure. This method employs a first mold to create a simple cylindrical preform having only the general geometry of the intended gear. A second mold is provided having the specific geometry of the gear and is slightly larger than the preform. The preform is placed inside the second mold, wherein additional powder metal is provided adjacent the preform to produce a second preform having a helical gear shape. Cold isostatic pressure is used to create both the simple preform and the helical gear preform. After the helical gear preform is made, hot isostatic pressure and/or sintering is employed to create the densified helical gear.

Isostatic pressure forming can generally involve placing a gear preform within a mold cavity having the specific geometry of the helical gear. For an outer diameter helical gear, a rubber bladder is inserted thorough a center bore in the gear. Fluid is pumped into the rubber bladder at extremely high pressures, thus radially expanding the preform against the walls of the mold cavity, and causing it to take on the helical gear shape. If an inner diameter helical gear is desired, a solid core rod having a helical gear profile engages the inner diameter of the preform and inward pressure is applied to the outer diameter of the preform resulting in the inner diameter taking on the helical gear profile. A disadvantage with isostatic forming is that it can take much longer for the process to fully densify the gear. In hot forming, enormous amounts of pressure can be generated in an instant by impacting the gear axially. In contrast, with isostatic pressure it may take time to build up sufficient pressure and it may be preferable to keep the gear subjected to the pressure for a relatively long time to ensure that the preform fully conforms to the specific geometry of the helical gear. Also, for example, obtaining accurate dimensions can be difficult when using isostatic pressure forming. There is generally no mold abutting the axial ends of the gear. Thus, the axial dimension can be difficult to accurately control. Consequently, more finishing steps can be required to obtain final dimensions having the desired accuracy. Moreover, besides controlling the length of the gear, the lack of control over the axial dimension can also make it more difficult to fully density the gear. This is because without control over the axial dimension, the gear can experience some undesirable axial expansion in addition to the radial expansion.

Yet another method for producing helical gears utilizes cutting. Generally, a piece of steel bar stock is chosen and cut to the desired length. The gear profile is then cut into the preform. The disadvantage of this type of method is that the equipment used in this method is slow, expensive and labor intensive, resulting in an expensive gear.

Accordingly, there is a need for a method of producing fully dense powder metal helical gears that can eliminate the step of creating a cylindrical preform and that can control both the axial and radial dimensions of the gear to create a helical gear with greater density, more accurate axial dimensions and less flashing. Consequently, less finishing steps may be necessary to obtain a final product.

The need also exists for a method of producing fully dense powder metal helical gears that does not form the gear profile by cutting and thus, decreases the cost of producing a high quality gear profile.

BRIEF SUMMARY OF THE INVENTION

The present invention provides a method for making a powder metal helical gear including providing powder metal in a preform mold having a rotating die member and a desired gear profile. The metallurgical powder metal may include, for example, any alloyed or unalloyed single metallurgical powder or combination of powders and metallurgical and non-metallurgical additives. The method further includes axially impacting the powder metal with the rotating die member to create a gear preform with the desired gear profile, sintering the gear preform, heating the preform, placing the preform in a hot forming mold having a rotating die member and a desired gear profile, and axially impacting the heated gear preform with the rotating die member to create a densified gear. Alternatively, the heating step may be eliminated and the preform can be removed from the sintering step and while still hot can be placed into the hot forming mold.

The present invention further provides a method for forming helical gears, wherein the helical gear teeth can be either on the inner diameter or the outer diameter of the gear.

A method for producing a fully dense powder metal helical gear according to the invention can include placing a desired powder metal composition into a first preform die. The metallurgical powder metal may include, for example, any single alloyed or unalloyed metallurgical powder or combination of powders and metallurgical and non-metallurgical additives. Preferably, the preform die has the specific shape and approximate dimensions of the desired finished article, for example, a helical gear. The powder metal can then be axially compacted by punches with enough force to generate sufficient pressure to create a helical gear preform. Next, the helical gear preform is sintered. The sintered preform can then be lubricated, heated, and delivered to a hot forming press. In the hot forming press, the sintered preform can be axially impacted by punches with sufficient force to generate enough pressure to fully densify the gear. As used herein, "fully densify" and "fully dense" refer to a gear having a density of greater than 96% of the theoretical density. The hot forming press may have a core rod and/or punches that may rotate. After the hot forming process the densified helical gear can be slowly cooled to room temperature at a rate so as to obtain a hardness less than Rockwell B 100, and preferably less than Rockwell B 75. From the slow cooling operation, the hot forming lubricant can be removed from the surface of the densified helical gear by grit blasting. After the grit blasting, the densified helical gear optionally can be lubricated and delivered to a burnishing press. In the burnishing press the densified helical gear optionally can be forced over a core rod having a helical profile or through a helical die cavity to impart the more precise dimensions desired of the final product. Additional finishing operations, such as rolling, shaving, heat-treating, machining to length and inner bore diameter grinding can be performed if desired.

Other details, objects, and advantages of the invention will become apparent from the following detailed description and the accompanying figures of certain embodiments thereof.

BRIEF DESCRIPTION OF THE SEVERAL VIEWS OF THE DRAWINGS

For the present invention to be understood and readily practiced, the present invention will be described in conjunction with the following Figures wherein.

DETAILED DESCRIPTION OF THE INVENTION

The present invention will be described below in terms of a method for forming powder metal gears. It should be noted that describing the present invention in terms of a method for forming powder metal gears is for illustrative purposes only and the advantages of the present invention may be realized using other structures and technologies that have a need for producing powder metal objects, wherein the method for producing powder metal objects is simple and inexpensive and the finished product may have more accurate dimensions, substantially eliminates flashing and has greater density. It is to be further understood that the Figures and descriptions of the present invention have been simplified to illustrate elements that are relevant for a clear understanding of the present invention, while eliminating, for purposes of clarity, other elements and/or descriptions that are well-known. Those of ordinary skill in the art will recognize that other elements may be desirable in order to implement the present invention. However, because such elements are well known in the art, and because they do not facilitate a better understanding of the present invention, a discussion of such elements is not provided herein.

Figure 1:
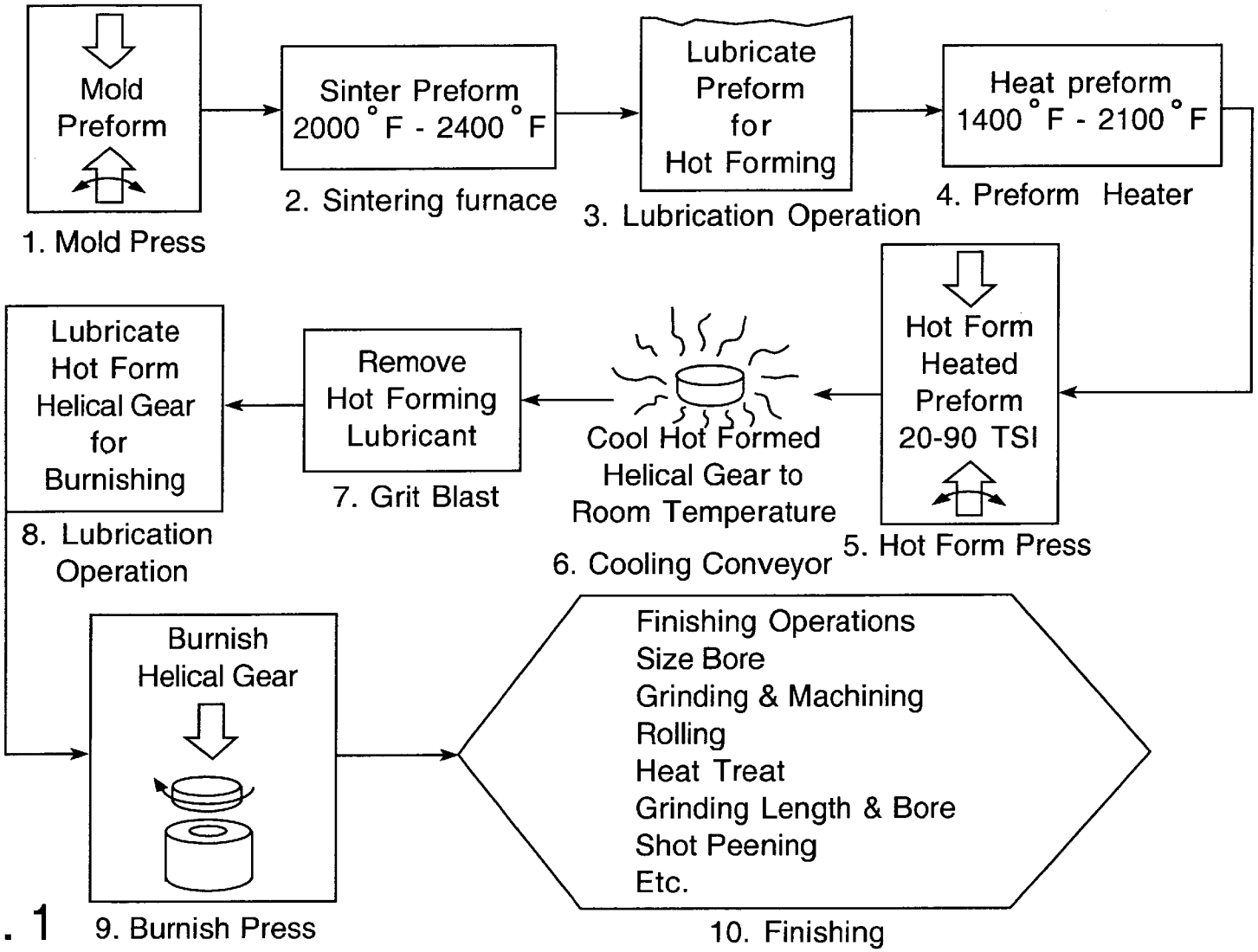
FIG. 1 is a flow diagram illustrating the method of the present invention.
Figure 2A:
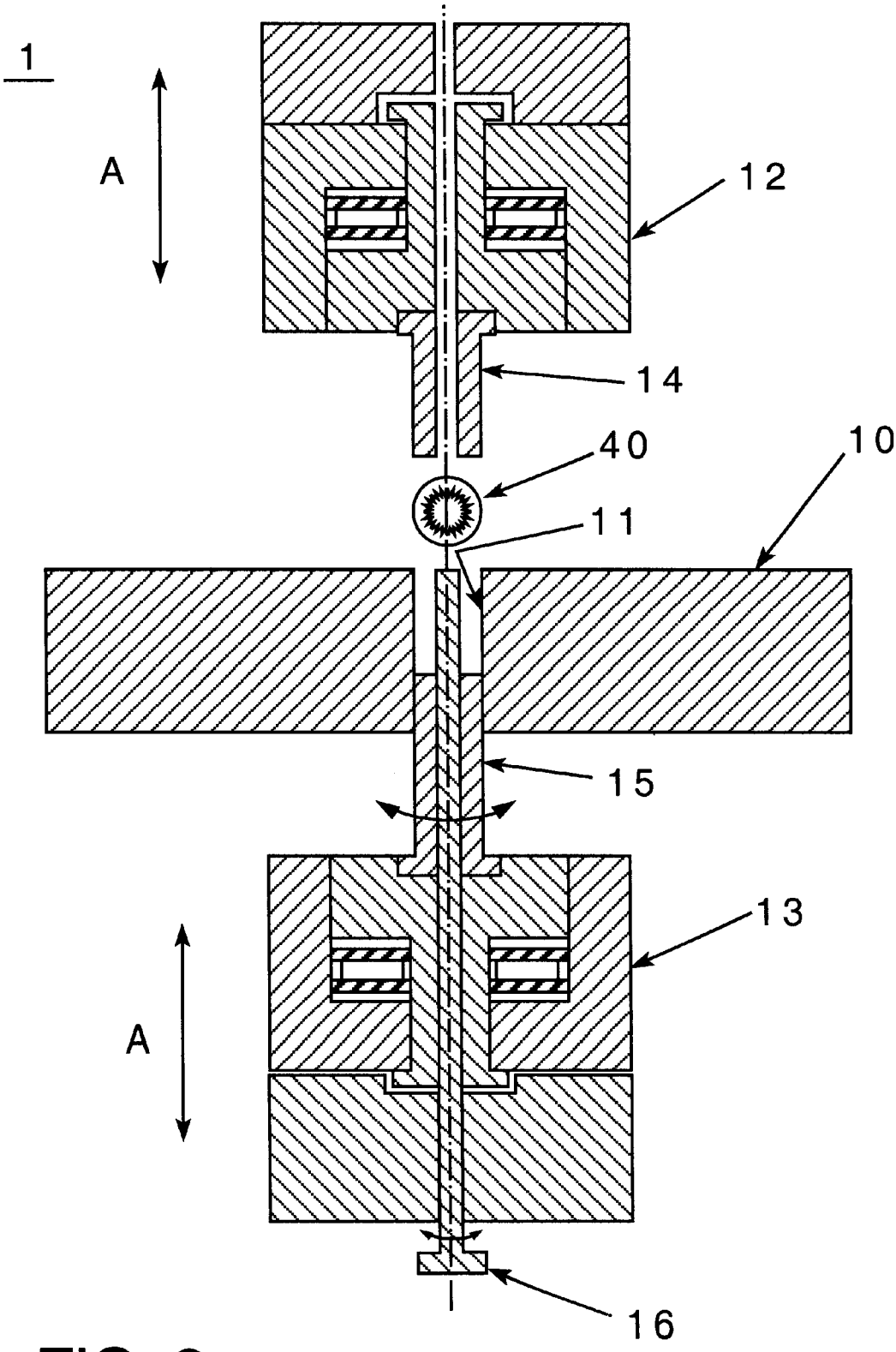
FIG. 2*a* is a schematic drawing of a mold preform press used in the method of the present invention.
Figure 4A:
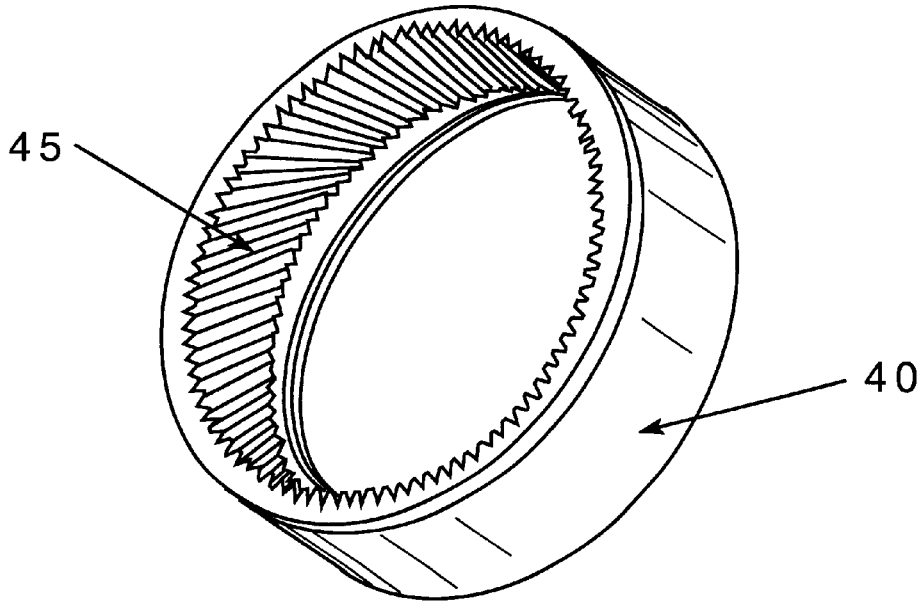
FIG. 4*a* is a perspective view of a powder metal helical gear preform produced using a method according to the present invention.

Referring now to the Figures, wherein like reference numbers refer to similar parts throughout the several views, a method for producing a fully dense powder metal helical gear is schematically shown in FIG. 1. The powder metal from which the gear is to be formed is selected and blended. As the phrase is used herein, powder metal may be, for example, any conventional or known powder metal formulation and may include a single alloyed or unalloyed metallurgical powder or a blend of one or more such powders and, optionally, other metallurgical and non-metallurgical additives such as, for example, lubricants. The selection of an appropriate powder blend is unimportant to the present invention and will be apparent to those of ordinary skill based on the properties desired in the finished part, and is not treated in any detail herein. The powder metal is delivered to the mold press 1 and then placed into a preform die 10 portion of the mold press 1, as shown in FIG. 2*a*. The preform press 1 preferably includes a die 10, an upper portion 12 and a lower portion 13. The lower portion 13 of the preform tools can have a punch 15 that has an external geometry to match the die 10. The punch 15 can rotate when it ejects the helical gear preform from the cavity 11. Both the lower portion 13 and the punch 15 can move in the vertical direction A. The lower portion 13 has a core rod 16 which can form the bore 45 of the preform 40 having helical teeth, as shown in FIG. 4*a*. In the case that the desired finished product is an inner diameter helical gear, the core rod 16 outer diameter should correspond to the gear profile such that when the core rod 16 rotates, it forms the inner diameter helical gear teeth in the preform 40 (shown rotated 90° to show inner diameter). Like the punch 15, the core rod 16 can rotate during powder compaction and preform ejection from the die 10.

The upper portion 12 may have a punch 14 that has a cross section corresponding to the cross section of the cavity 11. The upper portion 12 and the punch 14 are able to move in the vertical direction A. Although not shown or illustrated, the punch 14 can also rotate. Preferably, the die cavity 11 has the specific geometry of the desired article. For example, if the desired helical gear has outer diameter helical teeth, the cavity 11 should have a corresponding helical profile. Other types of gears can be formed using this process such as gears having square teeth and tapered teeth. Such rotating die members are disclosed in U.S. Pat. No. 3,891,367 issued to Signora. The teachings of Signora relating thereto are hereby incorporated herein by reference.

The method of the present invention provides that the powder metal can be axially compacted with enough force to generate sufficient pressure to create a helical gear preform having the specific geometry of the desired final product. The compaction is achieved by the punches 14 and 15 moving in the A direction and impacting the powder metal within the cavity 11, wherein the punch 15 and the core rod 16 rotate to form helical teeth on the inner diameter of the preform. Generally, about 40 tons per square inch (tsi) is applied to create iron-based helical gear preforms. However, this pressure may vary depending on, for example, the metal powder used and the article to be formed, and the pressure typically is in the range of 20 to 50 tsi. A helical gear preform 40 produced as described above can have the appearance shown in greater detail in FIG. 4*a*.

Figure 2B:
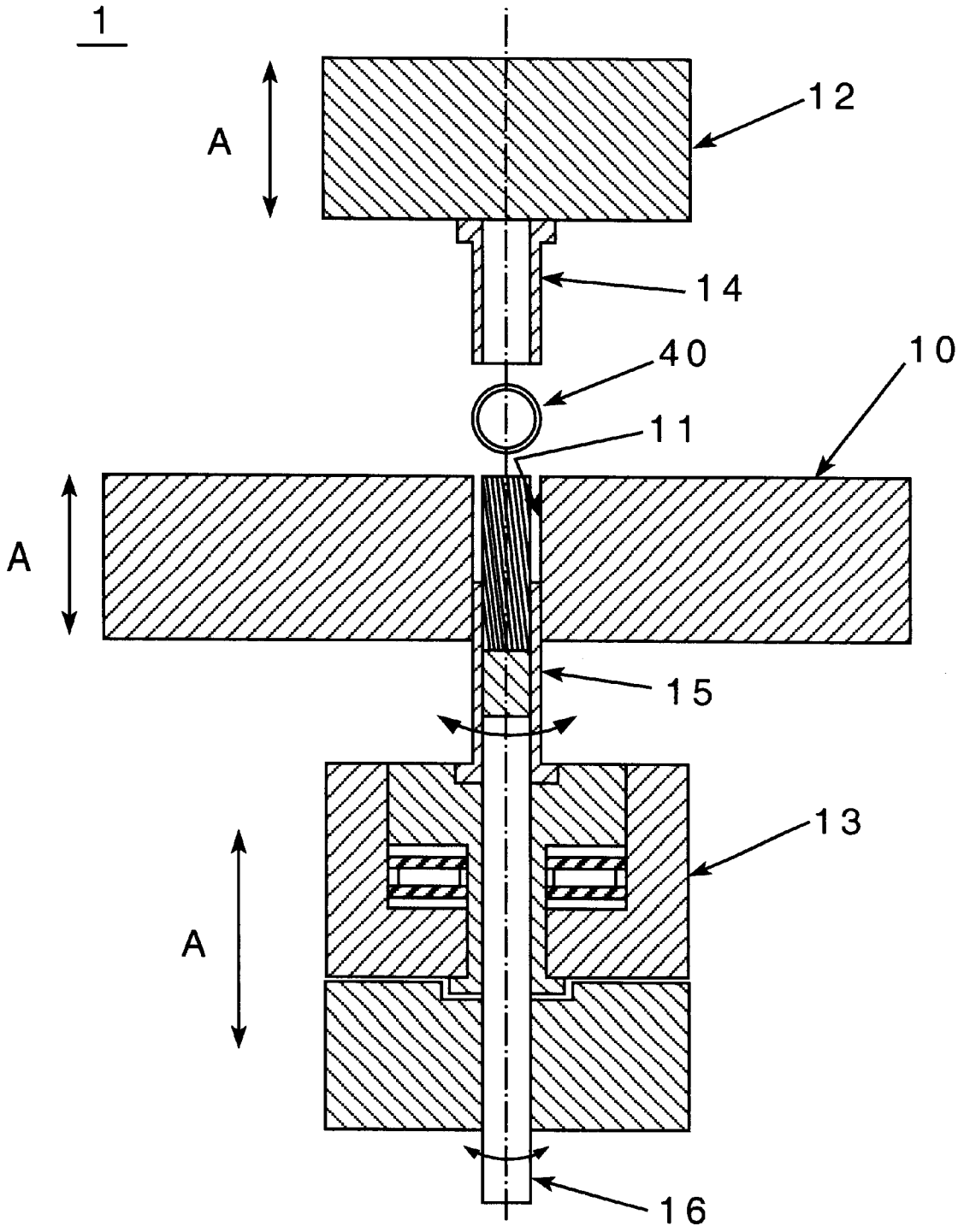
FIG. 2*b* is a schematic drawing of another mold preform press that may be used in the method of the present invention.

FIG. 2*b* is a schematic drawing of another mold preform that may be used in the method of the present invention to create the helical gear preform 40 shown in FIG. 4*a*. The powder is delivered to the mold press 1 and then placed into a preform die 10 portion of the mold press 1. The preform press 1 preferably includes a die 10, an upper portion 12, and a lower portion 13. The lower portion 13 has a punch 15 which has an external geometry to match the cavity 11. The punch 15 can rotate during molding and when it ejects the helical gear preform 40 from the preform die 10. Both the lower portion 13 and the punch 15 can move in the vertical direction A. The lower portion 13 of the preform tools can have a core rod 16 which can form the bore 45 of the preform 40 which has helical teeth, as shown in FIG. 4*a*. When the desired finished product is an inner diameter helical gear, the core rod 16 outer diameter should correspond to the gear profile such that when the core rod 16 rotates, it forms the inner diameter helical gear teeth in the preform 40. Like the punch 15, the core rod 16 can rotate during powder compaction and preform ejection from the die 10.

The upper portion 12 may have a punch 14 that has a cross section corresponding to the cross section of the cavity 11. The upper portion 12 and the punch 14 are able to move in the vertical direction A. The top punch 14 can be solid having no internal diameter. The core rod 16 and/or die 10 may be pushed down by punch 14, thus densifying the preform 40. Preferably, the preform die 10 has a die cavity 11 having the specific geometry of the desired article. For example, if the desired helical gear has outer diameter helical teeth, the cavity 11 should have a corresponding helical profile.

The method of the present invention provides that the powder metal can be axially compacted with enough force to generate sufficient pressure to create a helical gear preform 40 having the specific geometry of the desired final product. The compaction is achieved by the punches 14 and 15 and core rod 16 moving in the A direction and impacting the powder metal within the cavity 11, wherein the punch 15 and the core rod 16 rotate to form helical teeth on the inner diameter of the preform 40. Generally, about 40 tons per square inch (tsi) is applied to create iron-based helical gear preform. However, this pressure may vary depending on, for example, the metal powder used and the article to be formed, and the pressure typically is in the range of 20 to 60 tsi. A helical gear preform 40 (shown rotated 90° to show the inner diameter) produced can have the appearance shown in FIG. 4*a*.

Figure 2C:
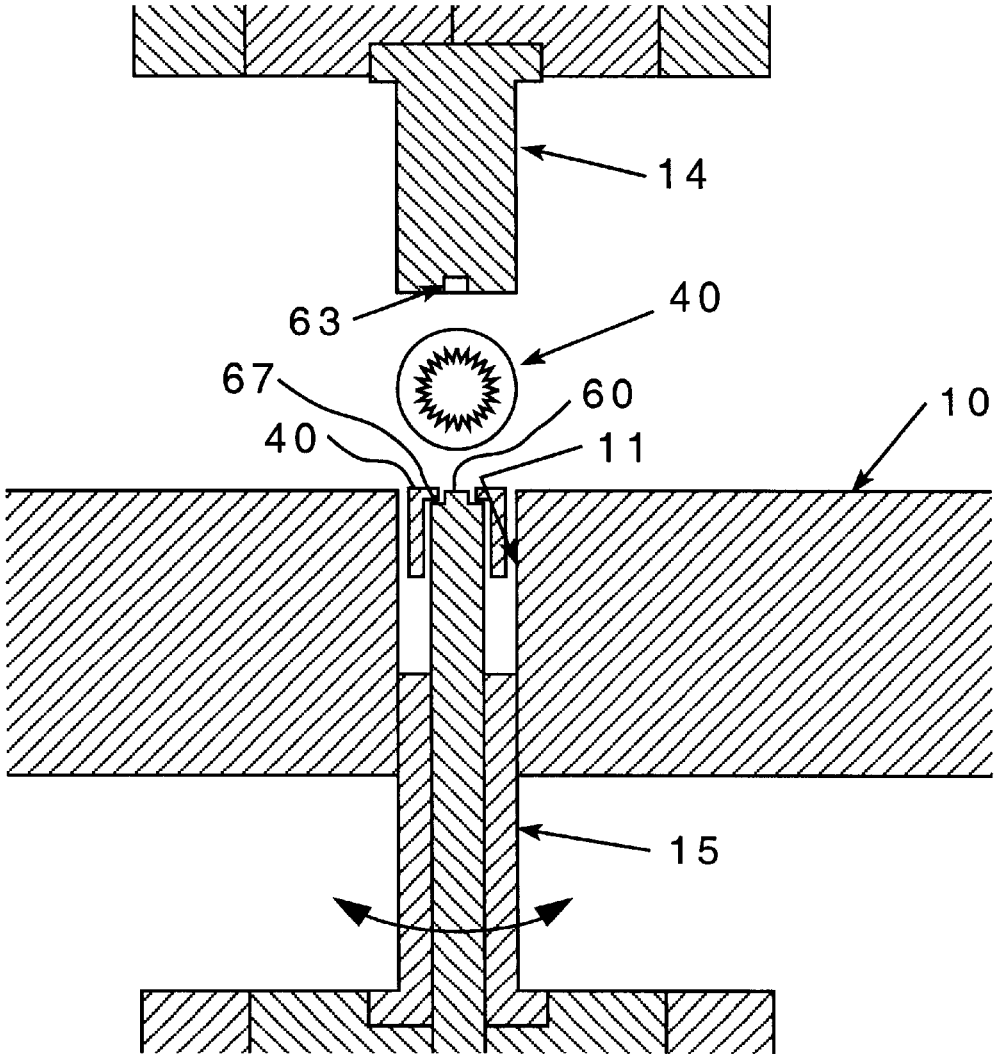
FIG. 2*c* is a schematic drawing of another mold preform press that may be used in the method of the present invention.

FIG. 2*c* is a schematic drawing of another mold that may be used in the method of the present invention when it is desired to have an internal flange 67 on the gear. The mold press 1 shown in FIG. 2*c* is similar to the mold presses shown in FIGS. 2*a* and 2*b* except for the following details. The core rod 16 can have an protrusion 60 that forms a shelf 61 on the top face of the core rod 16 equal to or less than the root diameter of the core rod 16, and the top punch 14 can have a undercut 63 that is sized and proportioned to receive the protrusion 60. This enables one to make a flanged internal helical gear. Thus, when the punches 14 and 15 move in the A direction and compact the powder metal within the die 10, a flange 67 is formed. Although not shown, the hot forming press 5 and the burnishing press 9 used in the method of the present invention must also be adapted to have similar protrusions and undercuts to that of the mold press shown in FIG. 2*c* if a helical gear having a flange is desired.

Referring again to FIG. 1, after ejection from the preform die 10, the helical gear preform 40 is placed in a furnace 2, where it is sintered as shown in FIG. 1. The sintering temperature is typically between 2000° F. and 2400° F. and may be, for example, 2070° for certain iron-based preforms. Depending on, for example, the type of powder metal and the desired article, the sintering temperature may vary. From the furnace 2, the helical gear preform 40 is cooled to room temperature. The sintered preform 40 is delivered to a lubrication operation 3 where the sintered preform 40 is coated with a high temperature lubricant that may be a commercially available lubricant such as boron, carbon or glass. However, instead of lubricating the sintered preform 40, the tools may be lubricated. The lubricated helical preform 40 is then delivered to a preform heater 4 where the preform 40 is heated to, for example, about 1850° F. Preferably, the sintered preform 40 is inductively heated; however, radiant heating and convection heating can also be used. The temperature can range from, for example, between 1400° F. and 2100° F. However, the temperature may vary depending on, for example, the type of metal powder being used and the characteristics of the article. Alternatively, this heating step may be eliminated and the preform can be removed from the sintering furnace 2 and while still hot can be placed into the hot forming mold 5 as discussed below.

Figure 3:
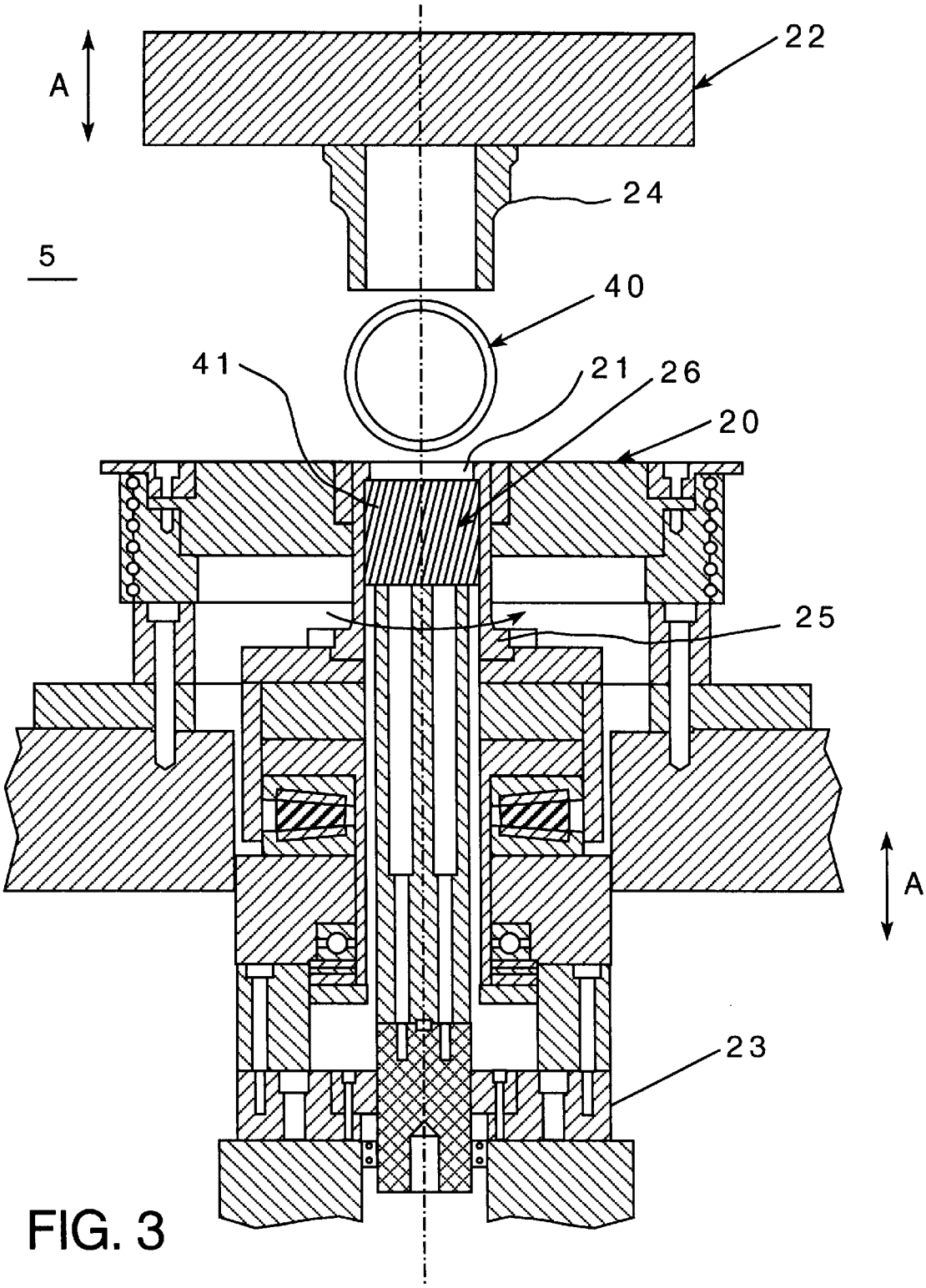
FIG. 3 is a schematic drawing of a hot forming press used in the method of the present invention.

From the preform heater 4 the preform 40 is then sent to a hot forming press 5, shown in FIG. 3. The hot forming press 5 includes a hot forming die 20 which is preferably maintained at a controlled temperature which can be typically about 600° F.; however, this temperature may vary. The hot forming press 5 has a die 20 with a cavity 21, an upper portion 22 and a lower portion 23. The upper portion 22 has an upper punch 24 that impacts the hot preform 40 and moves in the A direction. The upper punch 24 has an external geometry to match the die cavity 21. The lower portion 23 can have a core rod 26 which can support and form the bore 45 of the preform 40 in the hot forming process. The core rod 26 can rotate during the hot forming process. If a gear having an inner diameter gear profile is desired, the core rod 26 may have a corresponding gear profile 41 on its exterior surface. Alternatively, the cavity 21 may have a helical profile if it is desired that the finished gear have an outer diameter helical profile. However, if a gear having an inner diameter gear profile is desired, no gear profile is needed in the cavity 21.

Figure 4B:
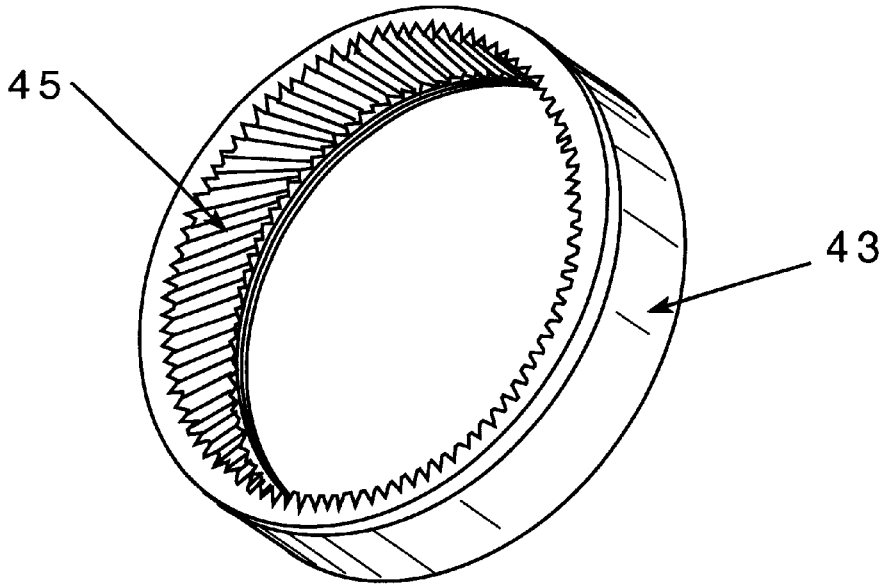
FIG. 4*b* is a perspective view of a powder metal helical gear produced using a method according to the present invention.

When the heated preform 40 is placed in the hot forming die 20, it is instantly axially impacted with sufficient force to generate enough pressure to fully densify the sintered helical gear preform 40 such that the fully densified gear, shown in FIG. 4*b*, is created. The pressure used for different types of powders and parts, typically is in the range of 20 to 90 tsi.

Thus, for example, the pressure may be about 40 tsi in certain embodiments of the present method. Immediately after impact, the densified helical gear 43, shown in FIG. 4*b*, is ejected form the die cavity 21. The core rod 26 can rotate as the densified gear 43 is ejected. The entire hot forming process may have a duration of, for example, only about one second, or less. As stated above, the previous heating step may be eliminated by taking the hot preform 40 from the sintering furnace 2, and while still hot placing the hot preform in the lubricated hot forming die 20.

A densified helical gear 43 produced according to the preceding preforming and hot forming steps can have the appearance shown in FIG. 4*b*. As can be seen from FIGS. 4*a* and 4*b*, the densified gear 43 has a shorter axial length than the sintered preform helical gear 40. However, both gears 40 and 43 have the same weight. The shorter helical gear 43 simply has greater density. The density of the helical gear preform 40 can be varied at the initial preforming process by varying the amount of powder metal in the preform die 10 shown in FIG. 1. As an example, when forming gears from conventional iron powder, the average density of the preform 40 is typically about 6.9 grams per cubic centimeter (g/cc), but can vary from, for example, 6.2 to 7.2 g/cc. The weight of the preform 40 can be critical and should be closely controlled. The final density of the helical gear 43 can be dependent on the impact of the axial force applied to the heated preform 40 in the hot forming die 20 shown in FIG. 3. When using conventional iron powder, the final density of the helical gear 43 is typically about 7.82 g/cc, but can vary from, for example, 7.5 to 7.85 g/cc. Maximum density generally corresponds to the minimum length of the densified helical gear for a given weight.

Figure 5A:
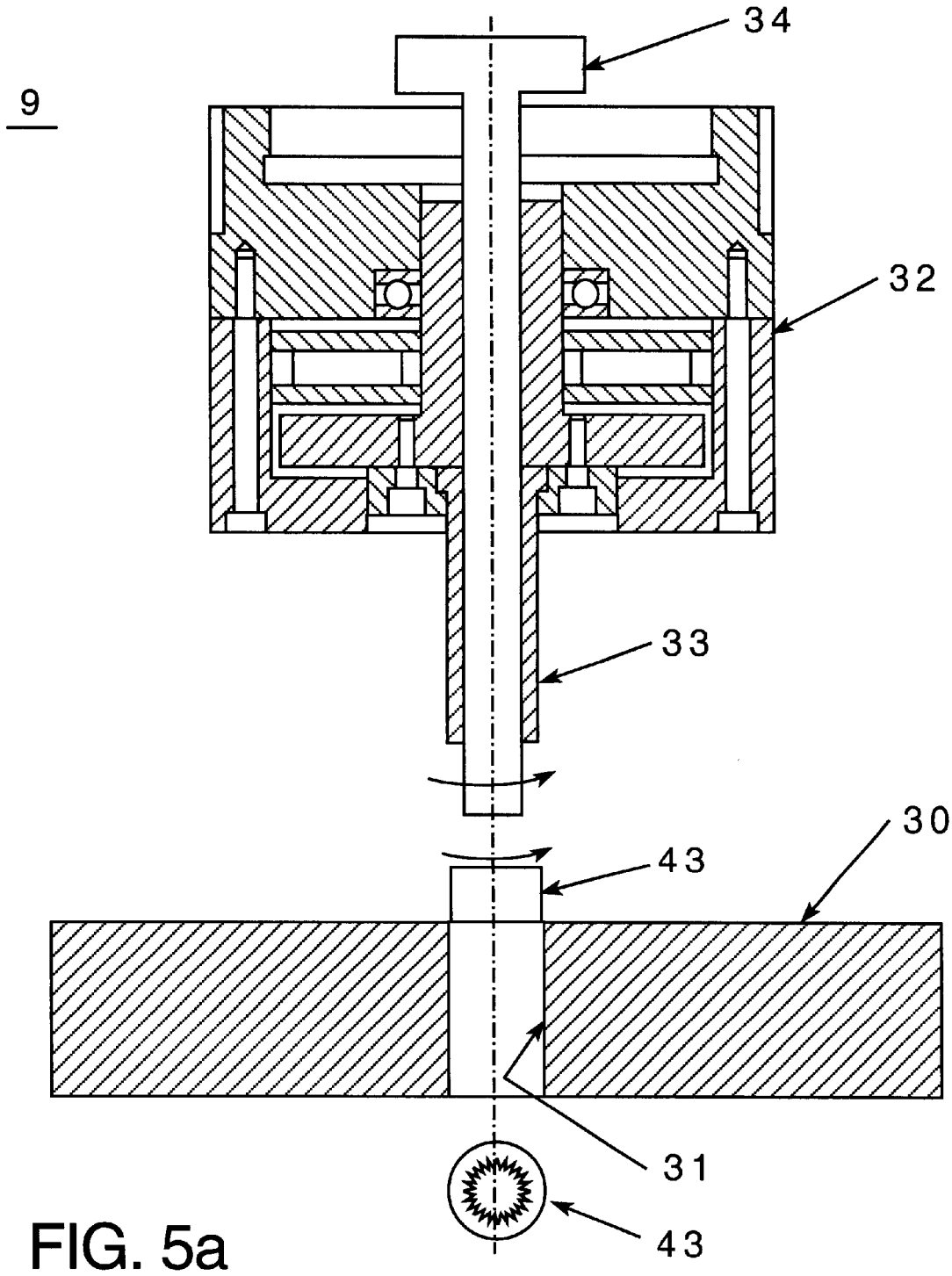
FIG. 5*a* is a schematic drawing of a burnishing press used in the method of the present invention.

After ejection from the hot forming die 20, the densified helical gear 43 is delivered to the cooling conveyor 6 where it can be cooled to room temperature as illustrated in FIG. 1. From the cooling conveyor 6, the densified helical gear 43 is grit blasted 7, lubricated 8 and delivered to a third, burnishing press 9 where it is placed in a burnishing die 30 of the burnishing press 9, as shown in FIG. 5*a*. The burnishing die 30 has an upper portion 32 with a punch 33 and a core rod 34. The punch 33 can be round or can have an external geometry to match the die cavity 31. The upper portion 32 can have a core rod 34 that can support the bore 45 of the densified helical gear 43 during burnishing. If an inner diameter helical gear is desired, the core rod 34 may have a helical gear profile on its outer diameter. Alternatively, the cavity 31 of the burnishing die 30 may have a helical profile if an outer diameter helical gear is desired. In the burnishing press 9, the densified helical gear 43 is forced through the die cavity 31 by the punch 33. The die cavity 31 has the exact dimensions that are desired to be embodied by the finished fully dense helical gear 43. In this process, the densified helical gear 43 rotates as it is pushed through the die cavity 31. The punch 33 and the core rod 34 can rotate with the densified helical gear 43 as it is pushed through the burnishing die 30. The burnishing step "trues up" the tooth profile of the densified helical gear 43. The precise dimensions of the helical teeth are imparted as the gear 43 is pushed through the die 30.

Figure 5B:
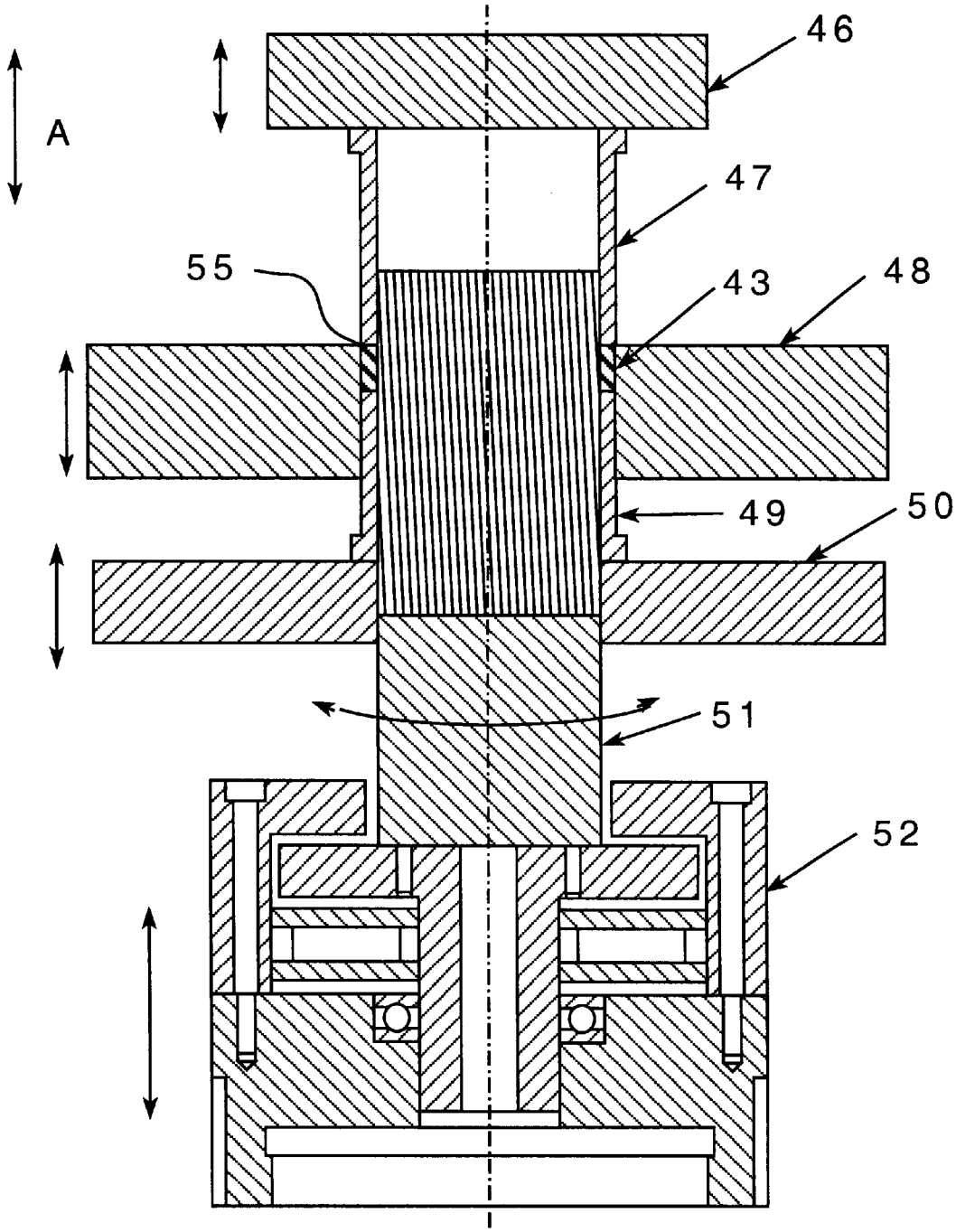
FIG. 5*b* is a schematic drawing of another burnishing press used in the method of the present invention.

FIG. 5*b* is a schematic drawing of another burnishing press that can alternatively be used in the method of the present invention. The burnishing die 48 has an upper portion 46 with a punch 47, an intermediate portion 50 with punch 49, and lower portion 52 with core rod 51. The punches 47 and 49 can be round or can have an external geometry to match the die cavity 55. The core rod 51 can support the inner diameter of the densified helical gear 43 during burnishing. Core rod 51 may rotate; however, punches 47 and 49 are fixed and do not rotate. During the burnishing step, the densified helical gear 43 is forced over the core rod 51 by the punch 47. The core rod 51 has the exact dimensions that are desired to be embodied by the finished fully dense helical gear 43. In this process, the densified helical gear 43 is pushed into the die cavity 55. Punches 47 and 49 have an internal diameter greater than the major diameter of core rod 51. The punches 47 and 49 do not rotate and the core rod 51 can rotate with the densified helical gear 43 as it is pushed into burnishing die 48 which may be required. The burnishing step "trues" up the tooth profile of the densified helical gear 43. The precise dimensions of the helical teeth are imparted as the internal helical gear 43 is pushed over the core rod 51. After the part 43 is burnished, it is ejected from the die by punch 49 and removed from the core rod 51.

At this stage the densified helical gear 43 has not yet been heat treated, i.e., hardened, and thus is still somewhat malleable. Consequently, the gear 43 can be better conformed to the exact dimensions of the die cavity 31 or 55 and helical profile of the core rod 34 or 51 as it is forced therethrough. Prior to the burnishing step, the densified helical gear 43 may only be a class 3 or 4. However, after burnishing, the gear 43 can have much more precise external dimensions and might be a class 7 through 10. This classification is defined by the American Gear Manufacturers of America (AGMA) and is readily known to those of ordinary skill. Such gears are classified, in one respect, according to the precision with which the external dimensions are maintained to the specified dimensions during production. On a scale of 1 to 10, a class 1 gear would have external dimensions with the least degree of precision, whereas a class 10 gear would have external dimensions with the highest degree of precision.

Additional, final finishing treatments can be performed after burnishing if desired. As illustrated in FIG. 1, for example, the densified helical gear 43 is hardened by heat treating. Also, the densified helical gear 43 can be machined or ground to desired axial lengths. Further, the smooth surfaces can be machined or ground to a desired diameter, for example, the bore of the gear can be sized. Further, the densified helical gear profile can be shaved and/or rolled to obtain an even more precise tooth profile. Other finishing treatments include rolling, heat treating, inductive heating and shot peening.

Although the helical gears 40 and 43 illustrated in FIGS. 4*a* and 4*b* are shown having a center bore 45, they can also be produced as a solid piece. Moreover, the method described above could also be employed to create a gear having a shaft portion, various other gear profiles on either the inner or outer diameter thereof, or other such differently shaped portions as permitted by multilevel molding or differently designed cavities, as is known to those skilled in the art.

Accordingly, although certain embodiments of the invention have been described in detail, it will be appreciated by those skilled in the art that various modifications to those details could be developed in light of the overall teaching of the disclosure. As such, the particular embodiments disclosed herein are intended to be illustrative only and not limited to the scope of the invention that should be awarded the full breadth of the following claims and any and all embodiments thereof.

Those of ordinary skill in the art will recognize, however, that many modifications and variations of the present invention may be implemented without departing from the spirit and scope of the present invention. The foregoing description and the following claims are intended to cover such modifications and variations.

What we claim is:

1. A method for making a powder metal gear having a helical gear profile on an inner diameter thereof, the method comprising:

providing powder metal in a die cavity of a preform mold comprising a rotating punch, a non-rotating punch, and a die including the die cavity;

axially impacting the powder metal with the rotating punch within the die cavity so as to compact the powder metal between the rotating punch and the non-rotating punch to create a gear preform;

sintering the gear preform;

placing the sintered gear preform in a hot forming mold comprising a die and a rotating punch; and axially impacting the heated gear preform with the rotating punch of the hot forming mold to create a densified gear having a helical gear profile on an inner diameter thereof.

2. The method of claim 1, further comprising providing the preform mold with a rotating core rod, wherein the rotating core rod has a helical gear profile on an exterior surface thereof.

3. The method of claim 1, further comprising providing the hot forming mold with a rotating core rod having a gear profile on an exterior surface thereof.

4. The method of claim 1, further comprising:

placing the densified gear in a burnishing press having a burnishing die with a desired gear profile and a rotating punch; and forcing the densified gear through the die cavity with the rotating punch.

5. The method of claim 4, further comprising providing the burnishing press with a rotating core rod.

6. The method of claim 5, further comprising providing the core rod with a desired gear profile on an exterior surface thereof.

7. The method of claim 1, wherein the preform is sintered at between approximately 2000° F. and 2400° F.

8. The method of claim 1, further comprising processing the densified gear using at least one techniques selected from the group consisting of grinding, machining, rolling, heat treating, shaving and shot peening.

9. A gear including a helical gear profile on an inner diameter thereof, the gear made in accordance with the method of claim 1.

10. The gear of claim 9, wherein said gear is a flanged inner diameter helical gear.

* * * * *

UNITED STATES PATENT AND TRADEMARK OFFICE

CERTIFICATE OF CORRECTION

PATENT NO. : 6,592,809 B1 
DATED : July 15, 2003
INVENTOR(S) : Gary L. Anderson and Jerome E. Muroski It is certified that error appears in the above-identified patent and that said Letters Patent is hereby corrected as shown below:

Column 2,
Line 25, delete the word "density" and substitute therefore -- densify --.

Column 5,
Line 18, insert -- press -- after the word "perform";
Line 60, delete the word "preform" and substituete therefore -- preforms --.

Column 6,
Line 4, delete "an protrusion" and substitute therefore -- a protrusion --;
Line 7, delete "a undercut" and substitute therefore -- an undercut --;
Line 21, delete "2070º" and substitute therefore -- 2070ºF --.

Column 7,
Line 4, delete the word "form" and substitute therefore -- from --

Column 10,
Line 18, delete the word "techniques" and substitute therefore -- technique --.

Signed and Sealed this

Fifteenth Day of June, 2004

JON W. DUDAS
*Acting Director of the United States Patent and Trademark Office*